US010518936B2

(12) United States Patent
Lott et al.

(10) Patent No.: US 10,518,936 B2
(45) Date of Patent: Dec. 31, 2019

(54) PLUG FOR RELEASABLY SEALING A CONNECTION CHANNEL AND METHOD FOR MIXING TWO COMPONENTS

(71) Applicant: KAO GERMANY GMBH, Darmstadt (DE)

(72) Inventors: Manfred Lott, Darmstadt (DE); Frank Zeiter, Darmstadt (DE)

(73) Assignee: KAO GERMANY GMBH, Darmstadt (DE)

( * ) Notice: Subject to any disclaimer, the term of this patent is extended or adjusted under 35 U.S.C. 154(b) by 227 days.

(21) Appl. No.: 15/309,884

(22) PCT Filed: May 19, 2015

(86) PCT No.: PCT/EP2015/061017

§ 371 (c)(1),
(2) Date: Nov. 9, 2016

(87) PCT Pub. No.: WO2015/177165

PCT Pub. Date: Nov. 26, 2015

(65) Prior Publication Data

US 2017/0267407 A1 Sep. 21, 2017

(30) Foreign Application Priority Data

May 21, 2014 (EP) ..... 14169336

(51) Int. Cl.
*B65D 25/08* (2006.01)
*A45D 19/02* (2006.01)
(Continued)

(52) U.S. Cl.
CPC ..... *B65D 25/085* (2013.01); *A45D 19/02* (2013.01); *A45D 34/04* (2013.01); *B65D 47/063* (2013.01); *B65D 81/3255* (2013.01)

(58) Field of Classification Search
CPC ..... B65D 25/085
(Continued)

(56) References Cited

U.S. PATENT DOCUMENTS 611,520 A * 9/1898 Smith ..... B65D 25/082 206/221
1,464,273 A * 8/1923 Schofflocher ..... 206/219
(Continued)

FOREIGN PATENT DOCUMENTS

WO 95/01285 A1 1/1995

OTHER PUBLICATIONS

International Search Report dated Sep. 16, 2015, dated Sep. 24, 2015.

*Primary Examiner* — David L Sorkin
(74) *Attorney, Agent, or Firm* — Norris McLaughlin, P.A.

(57) ABSTRACT

A plug for releasably sealing a connection channel connecting an upper chamber comprising a first component with a lower chamber comprising a second component of a two-chamber container, comprising a plug body for being inserted into the connection channel with a sealing force, a guiding member for guiding the plug in axial direction inside the upper chamber, wherein the guiding member comprises a larger extension in radial direction than the plug body and the guiding member is axially spaced to the plug body by an unsealing distance, and a head part for pushing out a folded nozzle sealing the upper chamber, wherein the head part protrudes from the guiding member away from the plug body.

17 Claims, 3 Drawing Sheets

Figure 1:
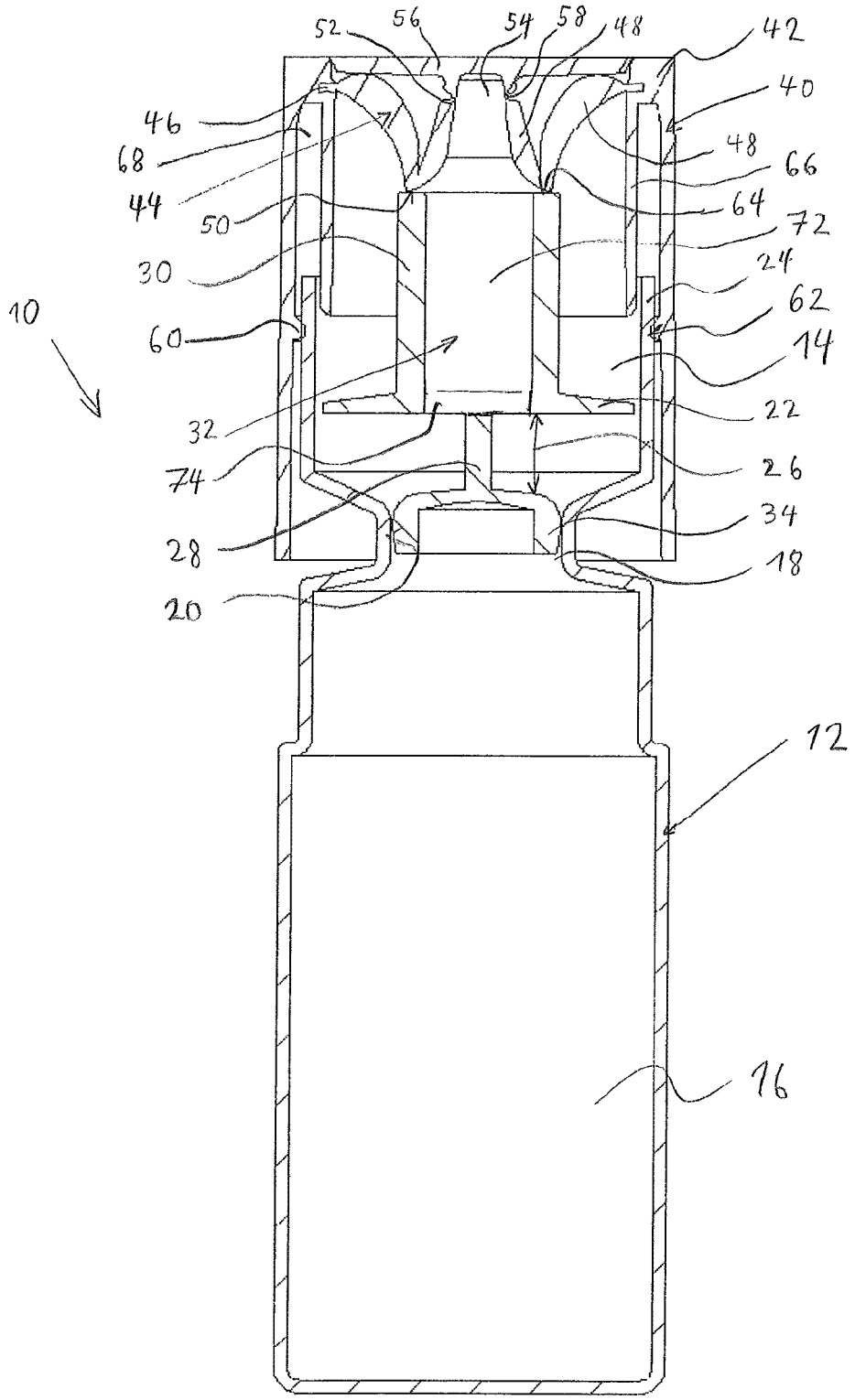

(51) Int. Cl.
*A45D 34/04* (2006.01)
*B65D 47/06* (2006.01)
*B65D 81/32* (2006.01)

(58) Field of Classification Search
USPC ..... 206/221; 215/DIG. 8
See application file for complete search history.

(56) References Cited

U.S. PATENT DOCUMENTS 2,807,384 A * 9/1957 Lipari ..... A61J 1/2093 206/221
2,813,649 A 11/1957 Lipari
3,321,097 A * 5/1967 Solowey ..... B65D 1/04 206/221
7,018,089 B2 * 3/2006 Wenz ..... A61M 5/31511 206/219
7,331,478 B2 2/2008 Aljadi

* cited by examiner

PLUG FOR RELEASABLY SEALING A CONNECTION CHANNEL AND METHOD FOR MIXING TWO COMPONENTS

This application is the U.S. National Stage of International Application No. PCT/EP2015/061017, filed May 19, 2015, which claims foreign priority benefit under 35 U.S.C. § 119 of European Application No. 14169336.6 filed May 21, 2014.

The invention relates to a plug, by means of which a connection channel connecting an upper chamber comprising a first component with a lower chamber comprising a second component of a two-chamber container may be releasably sealed, as well as to a and method for mixing two components, by means of which components of a two-chamber container may be mixed, wherein a connection channel of the of two-chamber container may be releasably sealed by such kind of a plug.

From U.S. Pat. No. 7,331,478 B1 a two-chamber container is known, comprising a cylindrical bottle with a valve separating the cylindrical bottle into an upper chamber and a lower chamber. The valve can be opened to connect the upper chamber with the lower chamber via a connection channel provided by the opened valve. The upper chamber is sealed by a cap comprising a flexible nipple protruding upwards from the cap.

WO 95/01285 discloses a plug for sealing a connection channel of a two-chamber container. The plug comprises a ring-shaped head part connected to plug body via arms.

There is a permanent need facilitating the mixture of two components in a two-chamber container.

It is an object of the invention providing measures enabling a facilitated mixing of two components in a two-chamber container.

The solution of this object is provided according to the invention by a plug according to the features of claim 1 and a method according to the features of claim 15. Preferred embodiments of the invention are given by the dependent claims, which can constitute each solely or in combination an aspect of the invention.

An aspect of the invention is directed to a plug for releasably sealing a connection channel connecting an upper chamber comprising a first component with a lower chamber comprising a second component of a two-chamber container, comprising a plug body for being inserted into the connection channel with a sealing force, a guiding member for guiding the plug in axial direction inside the upper chamber, wherein the guiding member comprises a larger extension in radial direction than the plug body and the guiding member is axially spaced to the plug body by an unsealing distance, and a head part for pushing out a folded nozzle sealing the upper chamber, wherein the head part protrudes from the guiding member away from the plug body.

When the plug body is positioned in the connection channel the first component stored in the upper chamber is separated from the second component in the lower chamber. The connection channel can be opened by pushing the plug downwards so that the plug body leaves the connection channel towards the lower chamber. When the connection channel is opened the first component of the upper chamber flows downwards through the connection channel into the lower chamber by gravity where the components may be mixed, particularly for providing a hair cosmetic composition. Since the guiding member is larger in radial direction than the plug body the guiding member can not be pushed through the connection channel so that the plug can not fall into the lower chamber but is at least partially retained in the upper chamber. The unsealing distance in axial direction between the guiding member and the plug body is designed such that when the guiding member meets a bottom of the upper chamber outside the connection channel the plug body is located outside the connection channel as a whole so that a gap is provided between the plug body and the top of the lower chamber and/or between the plug body and the connection channel.

During manufacturing of the two-chamber container the second component can be filled in the lower chamber and subsequent the connection channel can be sealed by means of the plug before the first component is filled in the upper chamber. Due to the guiding member the plug is guided along a wall of the upper chamber when the plug is assembled and the plug body is inserted, particularly press fitted, into the connection channel. Due to the protruding head part the plug can be gripped by hand and/or by a machine easily for moving the plug body downwards along the whole height of the upper chamber. A tilting of the plug can be prevented due to the guiding of the plug inside the upper chamber by means of the guiding member. Particularly it is facilitated providing a quite high sealing force of the plug body inside the connection channel without hampering the insertion of the plug into the two-chamber container.

The guiding member may be axially spaced to the plug body by the unsealing distance via an distance part connecting the guiding member with the plug body. The distance part connecting the guiding member with the plug body may provide the unsealing distance between the guiding member and the plug body. The distance part is arranged along the unsealing distance. The guiding member may protrude in radial direction from the distance part along the whole circumference of the guiding member. Thereby the guiding member may prevent a tilting of the plug in nearly any radial direction. Preferably the guiding member is designed mainly disk-like. A ratio r of the extension of the guiding member in radial direction to the extension of the guiding member in axial direction may be $5 \leq r_g \leq 25$, particularly $10 \leq r_g \leq 20$ and preferably $r_g = 15 \pm 2$. This provides a good guiding and a low friction for the guiding member. Particularly the radial extension of the distance part is smaller than the radial extension of the guiding member and the plug body. When the plug body is pressed out the connection channel of the two-chamber container the distance part is arranged at least partially inside the connection channel. Thereby a sufficient part of the connection channel is left free by the distance part and a fluid of the upper chamber may flow to the lower chamber via the connection channel passing the distance part of the plug.

The extension of the head part in axial direction is chosen such that the plug may interact with a foldable nozzle. The head part may even reach out the upper chamber upwards when the plug body is inserted in the connection channel. This enables an embodiment of the two-chamber container where the foldable nozzle is inaccessible for a person particularly arranged sunk into a cap movable in axial direction with respect to the upper chamber, so that the person is forced to first move the cap downwards until the foldable nozzle meets the head part of the plug so that the nozzle is unfolded by means of the head part upwards. Thus the nozzle is only accessible and can only be opened after the cap is moved downwards. Since the person is forced to first move the cap downwards for opening the two-chamber container it can be safeguarded that by moving the cap downwards the connection channel can be opened before the person opens the nozzle. By means of the plug design it can be safeguarded that first the components of the chambers are mixed before the two-chamber container is opened so that it is prevented that the first component of the upper chamber is discharged only without being mixed with the second component of the lower chamber. Particularly when the components of the chambers of the container should be mixed for providing a hair cosmetic composition, like a hair tinting means, unwanted color effects by not mixing the components can be prevented. The nozzle and/or the two-chamber container may be designed as described in WO 2014/090776 which content is herewith incorporated by reference.

Due to the guiding member and the head part protruding upwards from the guiding member a facilitated assembling of a two-chamber container as well as a facilitated handling of the two-chamber container is provided and an accidentally omission of a mixing of the components of the two-chamber container can be prevented so that a facilitated mixing of two components in a two-chamber container is enabled.

The plug body may comprise a hollow part which is preferably open either upwards or downwards. Particularly the plug body comprises an insertion chamfer for facilitating the insertion of the plug body into the connection channel. Preferably the plug body, the guiding member and the head part are one-piece. Preferably the plug body, the guiding member and the head part may be three-dimensional formed such that all parts of the plug may comprise mainly the same thickness. Particularly the plug is made from a plastic material, particularly a thermoplastic material. The plug may be made by injection molding. Particularly the plug may comprise a higher stiffness and/or rigidity than the two-chamber container. The head part may comprise an extension $h_H$ in axial direction, wherein the plug body comprises an extension $h_P$ in axial direction, wherein $1.0 \leq h_H/h_P \leq 10.0$, particularly $1.5 \leq h_H/h_P \leq 8.0$, preferably $2.0 \leq h_H/h_P \leq 6.0$ and particularly preferred $h_H/h_P = 3.0 \pm 1.0$ applies. Particularly with respect to the unsealing distance d $1.0 \leq h_H/d \leq 10.0$, particularly $1.5 \leq h_H/d \leq 7.0$, preferably $2.0 \leq h_H/d \leq 5.0$ and particularly preferred $h_H/h_P = 3.1 \pm 0.5$ applies. Particularly $1.0\ d/h_P \leq 2.0$, particularly $1.1\ d/h_P \leq 1.8$, preferably $1.2 \leq h_H/h_P \leq 1.6$ and particularly preferred $1.3 \leq h_H/h_P \leq 1.4$ applies.

It is understood that "up", "upwards", "upper chamber", "down", "downwards", "lower chamber" and the like characterizes a position and/or direction with respect to the direction of gravity when the assembled two-chamber container stands upright onto a horizontal ground, and the cap of the container is positioned at the upper end of the container. In assembled state of the two-chamber container the plug is inserted into the connection channel of the container so that the head part of the plug is located above the plug part of the plug, when the lower chamber of the two-chamber container is placed onto a horizontal ground.

Particularly the head part comprises a discharge channel communicating with a volume arranged in the unsealing distance by means of at least one discharge opening of the guiding member, wherein particularly the discharge opening corresponds to the cross sectional area of the discharge channel. The head part may be designed as particularly cylindrical tube bordering the discharge channel. Preferably the extension of the discharge channel in axial direction is larger than the extension of the guiding member in axial direction. The discharge channel may extend over the whole extension $h_H$ of the head part and the thickness of the guiding member in axial direction. A ration $r_d$ of the extension of the discharge channel in axial direction to the thickness of the guiding member in axial direction may be $5 \leq r_d \leq 20$, particularly $8 \leq r_d \leq 15$ and preferably $r_d = 11 \pm 2$. By means of this ratio a thin guiding member with a low friction may be provided, wherein via the long head part the folded nozzle may be pushed out easily. Due to the discharge channel of the head part the mixture of components inside the lower chamber of the two-chamber container may be easily poured out. The plug does not block or narrow unnecessarily the flow cross section when the mixture is discharged. Particularly the plug body may be retained spaced to the connection channel by means of the downwards moved cap when the two-chamber container is turned upside down for discharging the mixture out of the container. The head part may be designed hollow, particularly like a tube and/or a ring cylinder. When the plug body is located outside the connection channel the volume arranged in the unsealing distance may be located partially, particularly mainly, inside the connection channel. The volume arranged in the unsealing distance may be bordered in axial direction by the guiding member and the plug body and in radial direction by the container which may comprises a smaller diameter in the connection channel than in the upper chamber and/or the lower chamber.

Preferably the guiding member is connected to the plug body by at least one stiffening web, wherein particularly a plurality of cross-like arranged stiffening webs are provided, wherein particularly the at least one stiffening web is arranged in or outside an area covered by the cross sectional area of the discharge channel and/or the discharge opening in axial view. The distance part connecting the guiding member with the plug body may be provided by the stiffening web(s). Preferably the distance part consists of the stiffening web(s) only. Particularly the extension of the stiffening web corresponds to the unsealing distance. By means of the stiffening web it can be prevented that the plug body may bend or fold away with respect to the guiding member when inserted into the connection channel. The stiffening web may reach from the plug body to an underside of the guiding member pointing away from the head part. In the alternate the stiffening web may reach from the plug body into a discharge opening of the guiding member, particularly until a level where the head part starts, so that one larger discharge opening of the guiding member is divided into several smaller discharge openings by the material of the stiffening web. A suitable flow cross section as well as a suitable stiffening of the plug can be achieved by the design of the stiffening web(s). The stiffening web may be designed as a rib. Particularly the extension of the stiffening web in radial direction is larger than in circumferential direction. A ratio $r_s$ of the extension of the stiffening web in radial direction to the extension of the stiffening web in circumferential direction may be $5.0 \leq r_s \leq 15.0$, particularly $6.0 \leq r_s \leq 10.0$ and preferably $r_s = 8.0 \pm 1.0$. The extension of the stiffening web in radial direction is measured from its radial outer end to the center of the cross section at the maximum.

Particularly preferred the head part comprises a mainly ring-shaped contact surface for contacting a flexibly deformed intermediate part of the folded nozzle, wherein the intermediate part of the folded nozzle reaches axially inwards towards the upper chamber. The intermediate part of the nozzle may define a mainly ring-shaped folding line where two ring-shaped parts of the nozzle are folded to each other particularly for providing a zig-zag course in radial direction. Particularly the contact surface of the head part may meet an intermediate part of the folded nozzle protruding most downwards. It is used the insight that the intermediate part of the folded nozzle is mainly ring-shaped so that a ring-shaped contact surface of the head part is sufficient for unfolding the nozzle when the intermediate part of the folded nozzle meets the contact surface while the cap is moved downwards with respect the upper chamber. The material of the head part radially inside the ring-shaped contact surface can be saved so that the head part may be made at least partially hollow. Particularly a discharge channel can be formed inside the head part for facilitating a discharging of the mixed components.

Particularly the guiding member comprises a larger extension in radial direction than the head part, wherein the guiding member provides an abutting surface for abutting a pushing member of a cap relative movable with respect to the upper chamber in axial direction, wherein the abutting surface is located radially outwards with respect to the head part. Particularly the abutting surface points mainly upwards away from the plug body. The pushing member of the cap may protrude downwards into the upper chamber. When the cap is moved downwards with respect to the upper chamber the pushing member may meet the abutting surface so that the guiding member and hence the plug is taken along downwards so that the plug body can be pushed out of the connection channel by means of the cap applying a force to the abutting surface of the guiding member. Since the abutting surface is located radially outwards with respect to the head part the interaction of the head part with the foldable nozzle is not affected. Particularly the abutting surface is part of the ground of a groove or the like, which is particularly provided with a chamfer, so that the pushing member of the cap may be guided into a defined relative position to the plug when meeting the guiding member.

Preferably the guiding member comprises at least one recess at its radial outer circumference, wherein the recess provides a clearance between a wall of the upper chamber and the guiding member. Particularly the extension of the recess in circumferential direction is smaller than the extension of the guiding member in circumferential direction outside the recess. A friction between the radial outer circumference of the guiding member and a particularly cylindrical wall of the upper chamber can be reduced. Particularly the circumferential part of the guiding member for contacting the upper chamber is large enough for providing a sufficient guiding and preventing a tilting of the plug. Further the filling of the first component into the upper chamber, when the plug body is inserted into the connection channel, and/or the discharging of the mixed components are facilitated. Due to the recesses in the guiding member a suitable flow cross section through the guiding member can be provided.

Particularly preferred the plug body comprise at least one lamella protruding radially outwards for being clamped between the plug body and the connection channel for providing the sealing force. The lamella may be flexible in axial direction so that the lamella can be bended when the plug body is inserted into the connection channel. Due to the bending the lamella provides a spring force in radial direction which provides a good sealing. Further the lamella may prevent a movement of the plug upwards when the plug body is inserted in the connection channel. Thereby it may be prevented that the connection channel is accidentally opened when the lower chamber is squeezed leading to an increased pressure inside the lower chamber. At the same time the insertion of the plug body into the connection channel during assembling is possible without problems.

Particularly preferred at least two lamellae are provided wherein the most upper lamella comprises a larger extension in radial direction than the at least one further lamella. The most upper lamella may provide a stop when the plug body is inserted into the connection channel. Due to the larger lamella a defined relative position in the axial direction of the plug body to the connection channel can be safeguarded during assembling. At the same time also the larger most upper lamella can be bended for pushing the plug body through the connection channel when a suitable increased force is applied to the plug.

The invention is further directed to a container for storing and mixing two components, comprising an upper chamber for storing a first component, a lower chamber for storing a mainly liquid second component and mixing the first component with the second component, a connection channel connecting the upper chamber with the lower chamber, a cap for sealing the upper chamber, wherein the cap is relative movable with respect to the upper chamber in axial direction, wherein the cap comprises a foldable nozzle, wherein the nozzle protrudes upwards from the cap in unfolded state and protrudes at least partially downwards in the folded state, and a plug which may be designed as previously described for sealing the connection channel, wherein the plug is movably receivable by the connection channel, wherein a distance in axial direction of the nozzle to the head part in the folded state of the nozzle is smaller than a distance in axial direction of a cap body of the remaining cap to the plug. The nozzle and/or the two-chamber container may be designed as described in not published PCT/EP2013/076034 which content is herewith incorporated by reference. Due to the guiding member and the head part protruding upwards from the guiding member of the plug a facilitated assembling of the two-chamber container as well as a facilitated handling of the two-chamber container is provided and an accidentally omission of a mixing of the components of the two-chamber container can be prevented so that a facilitated mixing of two components in a two-chamber container is enabled.

When the container is placed in upright position onto a ground the upper chamber may be positioned above the lower chamber in direction of gravity. The lower chamber may comprise a standing surface to be placed onto the ground. The cap and/or the nozzle may be located at the highest point of the container. The plug may be frictionally engaged inside the connection channel sealing the connection channel such that the second component of the lower chamber is separated from the first component of the upper chamber. When the plug body is pressed through the connection channel the first component of the upper chamber may flow into the lower chamber so that both components may be mixed. The lower chamber comprises a volume which is large enough receiving not only the second component but also the first component. If so, the volume of the lower chamber is large enough for providing an additional volume for facilitating a mixing of the components by shaking the container by hand. Particularly the connecting channel is designed like a narrow neck between the upper chamber and the lower chamber, wherein preferably the length of the connection channel in axial direction is much lower than the axial length of the upper chamber or the lower chamber. Preferably the axial length z of the connection channel is $0.2\ cm \leq z \leq 5.0\ cm$, particularly $0.5\ cm \leq z \leq 4.0\ cm$, preferably $1.0\ cm \leq z \leq 3.0\ cm$ and most preferred $z = 2.0\ cm \pm 0.5\ cm$.

Particularly the nozzle comprises a foldable nozzle body, particularly made from a flexible material, the nozzle body comprising a mainly ring-shaped connecting part connected to the cap body of the cap, a tip arranged mainly in the centre of the nozzle body, wherein the tip comprises a predetermined breaking line for providing an outlet in broken state, at least one intermediate folding ring connecting the tip with the connecting part so that the tip is movable relative to the connecting part in axial direction between a folded state, where the tip is arranged mainly radially inside the connecting part in radial view, and an unfolded state, where the tip is arranged mainly outside the connecting part in radial view, and a cover plate connected with the tip for covering the tip inside a volume bordered by the folding ring directly connected to the connecting part in folded state. Due to the cover plate the tip of the nozzle body is not easily accessible for a person so that the tip of the nozzle can not pulled out for unfolding the nozzle body. Particularly the cover plate may comprise the appearance like a push button. Preferably the cover plate may comprises a corresponding marking or writing on an outside surface pointing away from the tip that would lead a person not to pull the nozzle but to push the cap downwards. Hence the natural behavior of person using a two-chamber container provided with such kind of nozzle, particularly for applying a hair cosmetic composition, would not be pulling the nozzle but pushing the cap. By pushing down the cap the plug plugging the connection channel can be pushed away so that the components of both chambers can be mixed. For unfolding the nozzle body a force may be applied to the nozzle body from inside the nozzle, for example by meeting the plug when the cap is moving downwards. The mixture of the two-chamber container may be poured out via the outlet of the nozzle which usually can be only provided in the unfolded state of the nozzle body. The risk that the nozzle is opened for pouring out the content of a two-chamber container without mixing the components of both chambers before is at least significantly reduced so that a facilitated handling with the two-chamber container is enabled.

The parts of the nozzle body may be arranged in radial direction mainly in series in the folded state. Particularly the connecting part covers 98%-100% of the axial extension of the intermediate folding ring(s) and/or the tip in side view in folded state of the nozzle body. Particularly preferred the connecting part may cover also the cover plate in side view in folded state of the nozzle body. The cover plate may comprise an outside surface pointing away from the tip, wherein the outside surface is flush with an upper rim of the folding ring(s) in the folded state or the outside surface is arranged on a level below the upper rim of the folding ring(s) in the folded state, when the container is placed upright onto a horizontal ground. The cover plate may be placed sunk into a volume radially bordered by the folding ring(s). Particularly the whole outside surface is positioned on or below the level of the upper rim of the folding ring(s) so that no latch or other part protrudes from the level of the outside surface above the level of the upper rim of the folding ring(s). Particularly the whole outside surface of the cover plate is an even plain so that protruding parts which could be grabbed for pulling the cover plate and the tip outwards are omitted. Preferably, no part protrudes from the outside surface of the cover plate upwards and even more no part of the cover plate or part directly connected to the cover plate protrudes above the level of the upper rim of the folding ring in the folded state.

The connecting part, the intermediate part(s) and the tip may have a zigzag course like an accordion in the folded state in sectional side view. The nozzle body may be designed like a funnel in the unfolded state, wherein preferably the tip of the funnel ends in the designated outlet closed by the cover plate. Particularly the breaking line may be provided in the transition between the tip and the cover plate. The breaking line may be an intended weakness in the material of the nozzle body, for instance a smaller wall thickness. In the unfolded state the tip particularly may be moved along an opening direction until the tip is spaced to the connection part via the at least one intermediate folding ring in axial direction so that the tip may be arranged completely outside the volume bordered by the connecting part.

The intermediate folding ring(s) may comprise a constant axial length along circumferential direction. However it is possible that the length differs for providing a curved course of the nozzle in unfolded state. The intermediate folding ring(s) may be flexible connected like a hinge to the connecting part and/or the tip so that the nozzle body is foldable at the transition area between the intermediate folding ring(s) with the connecting part and/or the tip and/or, if so, with each others. Particularly a film hinge or the like may be provided. In the folded state an outer surface of the intermediate folding ring, which is directly connected to the connecting part, pointing outwards in the unfolded state may point mainly radially inwards in the folded state bordering the volume where the tip is located in folded state. Due to the cover plate the tip may be mainly inaccessible for a person. Particularly the cover plate may be arranged mainly inside the volume bordered by the outer surface of the intermediate folding ring, which is directly connected to the connecting part. If a person tries to reach the tip his fingers would meet the outside surface of the cover plate or the outer surface of the intermediate folding ring. When the person tries to reach the rim of the cover plate it could be more likely that the cover plate is pushed downwards together with the tip for connecting the chambers of the two-chamber container than gripping the cover plate for pulling the tip out in the unfolded state.

Particularly the folding ring directly connected to the connecting part in folded state borders a maximum area $A_{fr}$ in folded state and the cover plate comprises an area $A_{cp}$, wherein the ratio $A_{cp}/A_{fr}$ is $0.75 \leq A_{cp}/A_{fr} \leq 1.20$, particularly $0.80 \leq A_{cp}/A_{fr} \leq 1.10$, preferably $0.850 \leq A_{cp}/A_{fr} \leq 1.00$ more preferred $0.90 \leq A_{cp}/A_{fr} \leq 0.99$ and most preferred $0.95 \leq A_{cp}/A_{fr} \leq 0.98$. Since at least a mayor part of area $A_{fr}$ of the volume bordered by the intermediate folding ring is covered by the cover plate, a finder of a person may not reach between the folding ring an the cover plate for gripping the cover plate. Particularly a minimum distance d between the cover plate and the folding ring is 0.0 mm≤d≤5.0 mm, preferably 0.5 mm≤d≤4.0 mm, more preferred 1.0 mm≤d≤3.0 mm and most preferred d=2.0 mm±0.5 mm.

Preferably the predetermined breaking line is breakable by turning and/or pulling the cover plate. In the unfolded state the cover plate is easily accessible by a person for being turned and/or pulled so that an outlet can be provided by breaking the breaking line. Particularly the breaking line is provided at a transition area between the tip and the cover plate.

Particularly preferred the nozzle body is one-piece and particularly made from a thermoplastic elastomer. The thermoplastic elastomer particularly comprises a hardness h in shore A of h≤h≤70, preferably 20≤h≤60 and particularly preferred 30≤h≤50. Due to the elastomeric material the tip of the nozzle body can be pushed along a sufficient length when the nozzle body is in the folded state. The connection part, the intermediate folding ring(s), the tip and the cover plate may be manufactured by injection molding for instance with a two-half mold and one core inset. A film hinge between subsequent parts and/or the breaking line provided by means of a smaller thickness may be provided by an appropriate design of the mold. Particularly the thickness of the nozzle body is thinner at a transition between the connecting part and the intermediate folding ring and/or between the intermediate folding ring and a further intermediate folding ring and/or between the intermediate folding ring and the tip for providing a designated folding line. The designated folding line may be designed like a film hinge. Due to the thinner parts of the nozzle body a predictable arrangement in folded state may be provided.

Preferably an unfolding force $F_u$ in axial direction for unfolding the nozzle from the folded state into the unfolded state is smaller than the sealing force $F_s$ in axial direction for sealing the connection channel, wherein particularly $1\ N \leq F_u \leq 20\ N$, preferably $2\ N \leq F_u \leq 15\ N$, more preferred $3\ N \leq F_u \leq 10\ N$ and particularly preferred $4\ N \leq F_u \leq 5\ N$ and/or $30\ N \leq F_s \leq 85\ N$, preferably $40\ N \leq F_s \leq 80\ N$, preferably $50\ N \leq F_s \leq 75\ N$, more preferred $55\ N \leq F_s \leq 70\ N$ and particularly preferred $60\ N \leq F_s \leq 65\ N$ applies. The sealing force is sufficient higher than the unfolding force so that the nozzle is unfolded first by means of the plug before the plug is moved for opening the connection channel. Thereby is it safeguarded that not the components of the two-chamber container are mixed without the possibility of opening the outlet of the not unfolded nozzle.

Particularly preferred the cap body comprises a pushing member protruding downwards for meeting the plug, particularly the guiding member, and for pushing the plug body of the plug downwards out of the connection channel when the cap is moved relative downwards with respect to the upper chamber. Even when the plug is not accessible from outside the container the plug can be pushed out of the connection channel when the cap is moved downwards and the pushing member meets the plug. The extension of the pushing member in axial direction is chosen such that the pushing member meets the plug and pushes the plug out of the connection channel before the maximal distance by which the cap can be moved downwards is reached by the cap.

Preferably a particularly ring-shaped pocket is formed between the pushing member and the remaining cap body, wherein a wall of the upper chamber is guided inside the pocket. The pushing member may not only push the plug out of the connection channel but also provides a guiding of the cap relative to the upper chamber. Due to the guiding provided by the pushing member a tilting of the cap relative to the upper chamber can be prevented so that particularly the pushing member may meet the plug in a defined manner.

Particularly the cap body comprises a snap lug for being inserted into a corresponding first snap recess for providing a defined relative axial position of the cap to the upper chamber in the folded state of the nozzle and/or a second snap recess for providing a defined relative axial position of the cap to the upper chamber in the unfolded state of the nozzle, wherein the first snap recess and/or the second snap recess is provided in a wall of the upper chamber. Due to the releasable snap connection between the cap and the upper chamber a defined axial position of the cap relative to the upper chamber for an upper position and/or a lower position can be provided. Due to the upper snap connection it can be prevented that the cap moves downwards unintentionally for instance by gravity or the like. Due to the lower snap connection the end of a reasonable movement of the cap downwards can be indicated.

Particularly preferred the upper chamber and/or the lower chamber provides a stop surface for abutting the cap body in its maximum downwards relative position of the cap with respect to the upper chamber. The cap may meet the upper chamber and/or the lower chamber when the end of a reasonable movement of the cap downwards is reached. An unnecessary further movement of the cap can be prevented. Particularly the stop surface meets the cap body but not the nozzle so that a damaging of the nozzle by means of a too far movement of the cap downwards can be prevented.

The invention is further directed to a method for mixing two components, particularly for providing a hair cosmetic composition like a mixed hair tinting means, whereby a container which may be designed as previously described is provided, the cap is moved downwards with respect to the upper chamber, the head part of the plug meets the folded nozzle and unfolds the nozzle while the cap is moved further downward, after the nozzle is unfolded the cap body meets the plug and pushes the plug body of the plug downwards out of the connection channel while the cap is moved further downward and mixing the first component with the second component located both in the lower chamber. Due to the guiding member and the head part protruding upwards from the guiding member a facilitated assembling of a two-chamber container as well as a facilitated handling of the two-chamber container is provided and an accidentally omission of a mixing of the components of the two-chamber container can be prevented so that a facilitated mixing of two components in a two-chamber container is enabled.

Particularly preferred at least the lower chamber is made from a flexible material for squeezing the container. By squeezing the container the volume provided by the container may be reduced so that a discharging of the mixed components may be facilitated.

Figure 2:
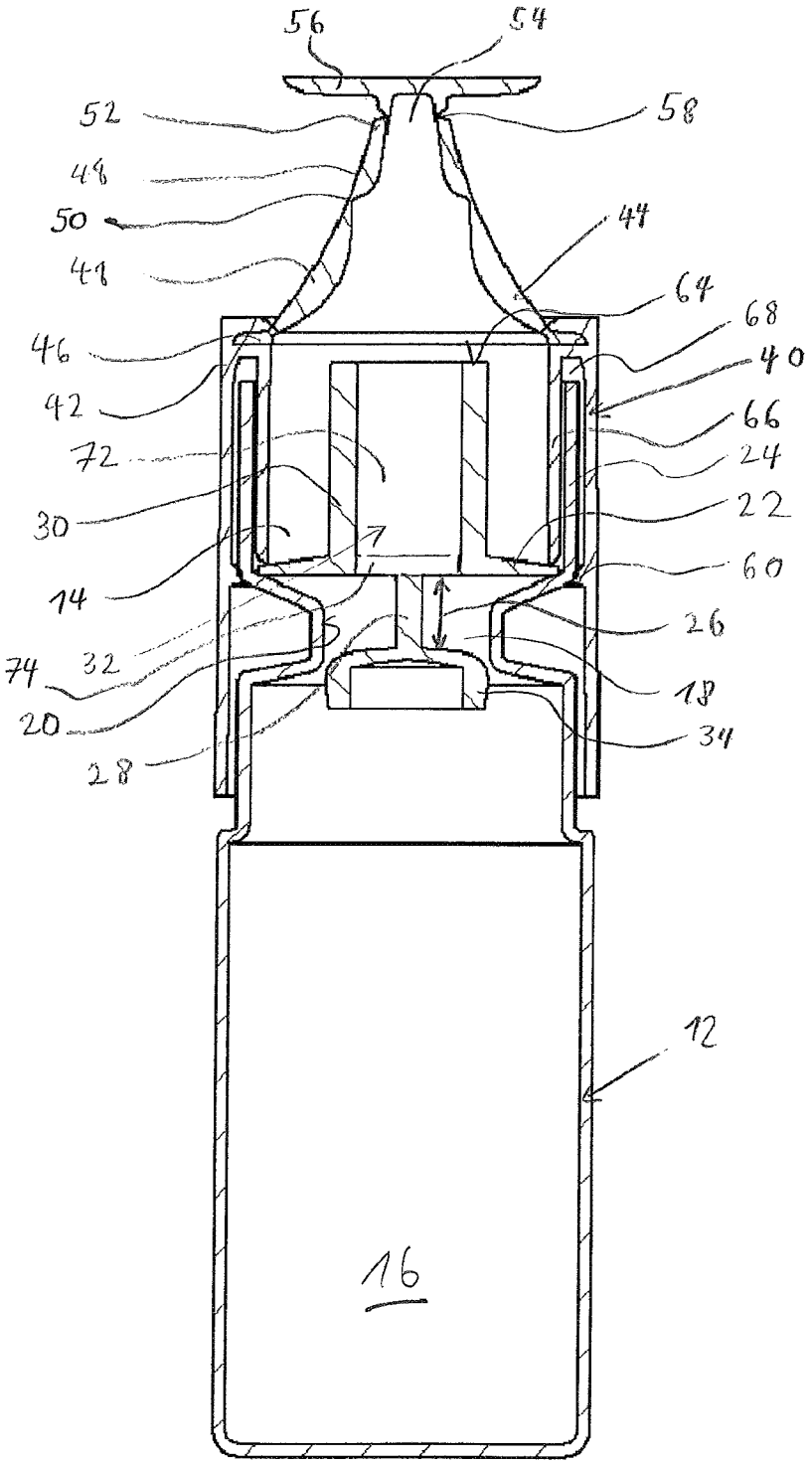
Figure 3:
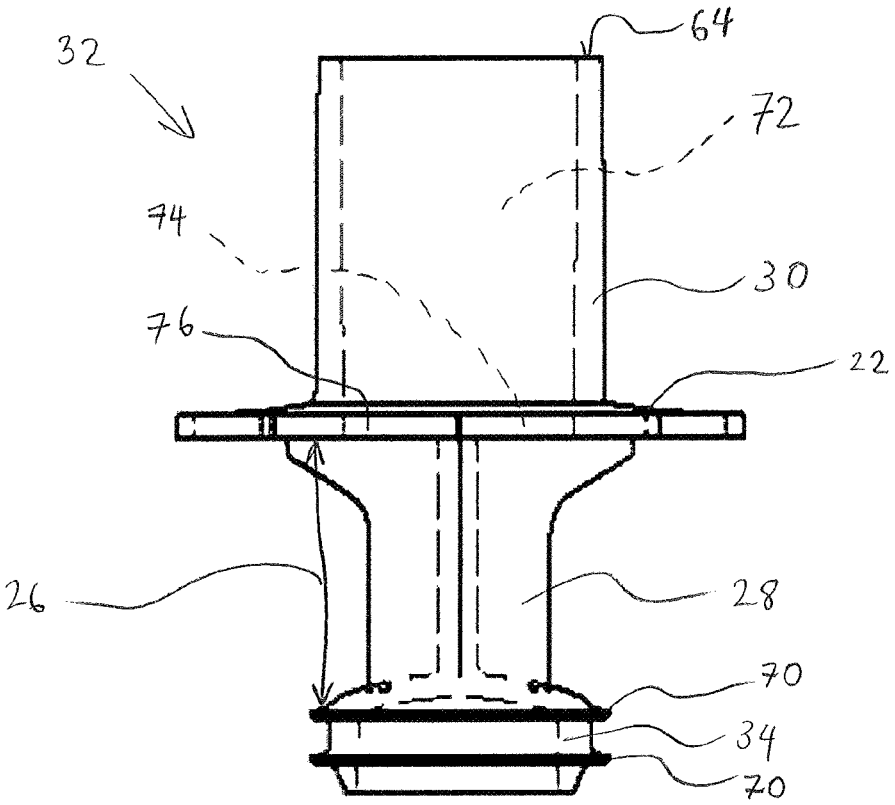
Figure 4:
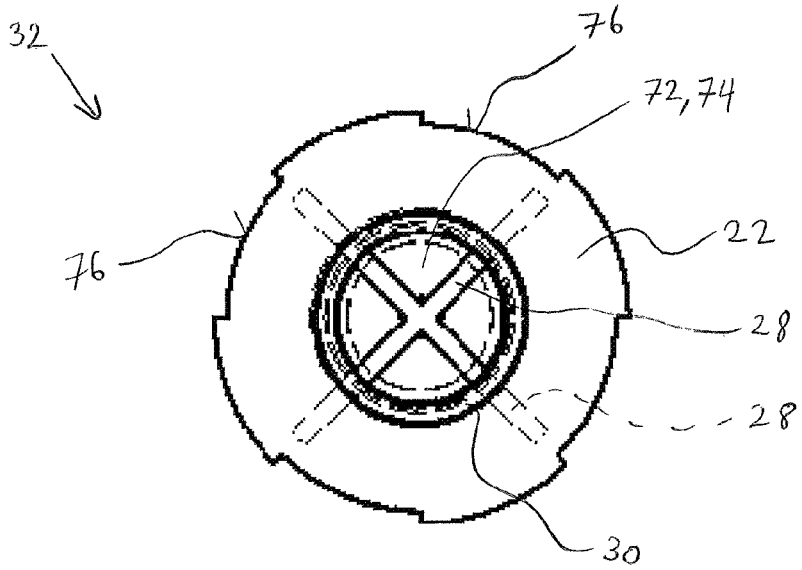

These and other aspects of the invention will be apparent from and elucidated with reference to the embodiments described hereinafter, wherein the described features can constitute each solely or in combination an independent aspect of the invention. In the drawings:

FIG. 1: shows a schematic sectional side view of a two-chamber container in folded state, FIG. 2: shows a schematic sectional side view of the two-chamber container of FIG. 1 in unfolded state, FIG. 3: shows a schematic side view of a plug for the container of FIG. 1 and FIG. 4: shows a schematic top view of the plug of FIG. 3.

The two-chamber container 10 as illustrated in FIG. 1 comprises a bottle body 12 by which an upper chamber 14 and a lower chamber 16 connected via a connecting channel 18 is provided one-piece. The connecting channel 18 is formed by a narrow neck 20 between the upper chamber 14 and the lower chamber 16.

A plug 32 is provided comprising a partially hollow plug body 34 for plugging and sealing the connection channel 18. The plug 32 comprises a guiding member 22 for guiding the plug 32 in axial direction at a wall 24 of the upper chamber 14. The guiding member 22 is connected spaced by an unsealing distance 26 via stiffening webs 28. A head part 30 of the plug 32 protrudes upwards from the guiding member 22. The head part 30 particularly comprises a larger diameter than the plug body 34.

A cap 40 is provided covering the upper chamber 14. The cap 40 is relative moveable with respect to the upper chamber 14. The cap 40 comprises a rigid cap body 42 and a flexible foldable nozzle 44 connected to the cap body 42 via a connecting part 46. The nozzle 44 comprises folding rings 48 foldable connected to each other via a bended intermediate part 50 utilized as a kind of film hinge. In the middle of the nozzle 44 a tip 52 is formed which defines an outlet 54 covered by a cover plate 56 connected to the tip via a breaking line 58.

In the illustrated embodiment the cap body 42 comprises a snap lug 60 which can be inserted into a snap recess 62 of the wall 24 of the upper chamber 14 in an upper start position of the cap 40. In the start position or when the cap 40 is moved downwards the intermediate part 50 of the nozzle 44 meets a ring-shaped contact surface 64 of the head part 30 of the plug 32 (FIG. 1). When the cap 40 is moved further downwards the head part 30 pushes the intermediate part 50 and the folding rings 48 upwards into the unfolded state of the nozzle 44 (FIG. 2). After this a ring-shaped pushing member 66 of the cap body 42 meets the guiding member 22 of the plug 32. When the cap 40 is moved further downwards the pushing member 66 pushes the plug 32 downwards until the plug body 34 is pushed out of the connecting channel 18 so that the connecting channel 18 is opened and a first component of the upper chamber 14 may flow into the lower chamber 16 for being mixed with a second component located in the lower chamber 16. The pushing member 66 and the remaining cap body 42 form a ring-shaped pocket 68 where the wall 24 of the upper chamber 14 is guided so that the cap 40 may not tilt when moved downwards.

As illustrated in FIG. 3 the plug body 34 may comprise at least one, particularly several, like three, circumferential lamellae 70 protruding in radial direction from the plug body 34. The free ends of the lamellae 70 are slightly bended upwards facilitating inserting the plug 32 into the connecting channel 18. Further the head part 32 is formed hollow so that a discharge channel 72 communicating with a volume arranged in the unsealing distance 26 via at least one discharge opening 74 provided in the guiding member 22 is formed. The stiffening webs 28 may reach until the underside of the guiding member 22 so that the cross section of the discharge opening 74 corresponds to the cross section of the discharge channel 72. In the alternate the stiffening webs 28 may reach from the plug body 34 into the discharge opening 74 of the guiding member 22 so that one larger discharge opening 74 of the guiding member 22 is divided into several smaller discharge openings 22 by the material of the stiffening webs 28.

As illustrated in FIG. 4 the guiding member 22 may comprises several recesses 76 at its outer circumference so that the guiding member 22 may contact the wall 24 of the upper chamber 14 only partially at its outer circumference. Further mixed components may flow through the gap provided by the recess 74 between the guiding member 22 and the wall 24 when the mixture should be poured out the container 10.

The invention claimed is:

1. A plug for releasably sealing a connection channel connecting an upper chamber comprising a first component with a lower chamber comprising a second component of a two-chamber container, the plug comprising a plug body, insertable into the connection channel with a sealing force, having a first diameter a guiding member having a disk shape, configured for guiding the plug in an axial direction inside the upper chamber, and connected to the plug body, wherein the guiding member comprises a second diameter that is greater than the first diameter of the plug body, the guiding member is spaced from the plug body, in the axial direction, by an unsealing distance, and the guiding member has a discharge opening formed therein and having a first cross-sectional area such that the discharge opening is in communication with a volume arranged in the unsealing distance, and a head part, configured for pushing out a folded nozzle sealing the upper chamber, connected to the guiding member such that the head part protrudes away from the guiding member in the axial direction, wherein the head part has a third diameter that is less than the second diameter of the guiding member, the head part has a discharge channel formed therein, having a second cross-sectional area, and extending an entire length of the head part from a first end of the head part to an opposing second end of the head part, and the discharge channel has a diameter that is constant or the same along the entire length of the head part from the first end of the head part to the opposing second end of the head part.

2. The plug according to claim 1, wherein the first cross-sectional area of the discharge opening corresponds to or is the same as the second cross-sectional area of the discharge channel.

3. The plug according to claim 1, wherein the guiding member is connected to the plug body by at least one stiffening web, wherein the extension of the stiffening web in radial direction is larger than in circumferential direction, wherein a plurality of cross-like arranged stiffening webs are provided, wherein at least one stiffening web is arranged in or outside an area covered by the cross sectional area of the discharge channel and/or the discharge opening in axial view.

4. The plug according to claim 1, wherein the head part comprises a mainly ring-shaped contact surface for contacting a flexibly deformed intermediate part of the folded nozzle, wherein the intermediate part of the folded nozzle reaches axially inwards towards the upper chamber.

5. The plug according to claim 1, wherein the guiding member comprises a larger extension in radial direction than the head part, wherein the guiding member provides an abutting surface for abutting a pushing member of a cap relative movable with respect to the upper chamber in axial direction, wherein the abutting surface is located radially outwards with respect to the head part.

6. The plug according to claim 1, wherein the guiding member comprises at least one recess at its radial outer circumference, wherein the recess provides a clearance between a wall of the upper chamber and the guiding member, wherein the extension of the recess in circumferential direction is smaller than the extension of the guiding member in circumferential direction outside the recess.

7. The plug according to claim 1, wherein the plug body comprise at least one lamella protruding radially outwards for being clamped between the plug body and the connection channel for providing the sealing force, wherein at least two lamellae are provided, wherein the most upper lamella comprises a larger extension in radial direction than the at least one further lamella.

8. A container for storing and mixing two components, the container comprising an upper chamber for storing a first component, a lower chamber for storing a mainly liquid second component and mixing the first component with the second component, a connection channel connecting the upper chamber with the lower chamber, a cap for sealing the upper chamber, wherein the cap is relative movable with respect to the upper chamber in the axial direction, wherein the cap comprises a foldable nozzle, wherein the nozzle protrudes upwards from the cap in unfolded state and protrudes at least partially downwards in the folded state, and the plug according to claim 1 for sealing the connection channel, wherein the plug is movably receivable by the connection channel, wherein a distance in the axial direction of the nozzle to the head part in the folded state of the nozzle is smaller than a distance in the axial direction of a cap body of the remaining cap to the plug.

9. The container according to claim 8, wherein the nozzle comprises a foldable nozzle body, the nozzle body comprising a mainly ring-shaped connecting part connected to the cap body of the cap, a tip arranged mainly in the centre of the nozzle body, wherein the tip comprises a predetermined breaking line for providing an outlet in broken state, at least one intermediate folding ring connecting the tip with the connecting part so that the tip is movable relative to the connecting part in axial direction between a folded state, where the tip is arranged mainly radially inside the connecting part in radial view, and an unfolded state, where the tip is arranged mainly outside the connecting part in radial view, and a cover plate connected with the tip for covering the tip inside a volume bordered by the folding ring directly connected to the connecting part in folded state.

10. The container according to claim 8, wherein an unfolding force $F_u$ axial direction for unfolding the nozzle from the folded state into the unfolded state is smaller than the sealing force $F_s$ in axial direction for sealing the connection channel, wherein $1\ N \leq F_u \leq 20\ N$ applies.

11. The container according to claim 8, wherein the cap body comprises a pushing member protruding downwards for meeting the guiding member, and for pushing the plug body of the plug downwards out of the connection channel when the cap is moved relative downwards with respect to the upper chamber.

12. The container according to claim 11, wherein a ring-shaped pocket is formed between the pushing member and the remaining cap body, wherein a wall of the upper chamber is guided inside the pocket.

13. The container according to claim 8, wherein the cap body comprises a snap lug for being inserted into a corresponding first snap recess for providing a defined relative axial position of the cap to the upper chamber in the folded state of the nozzle and/or a second snap recess for providing a defined relative axial position of the cap to the upper chamber in the unfolded state of the nozzle, wherein the first snap recess and/or the second snap recess is provided in a wall of the upper chamber.

14. The container according to claim 8, wherein the upper chamber and/or the lower chamber provides a stop surface for abutting the cap body in its maximum downwards relative position of the cap with respect to the upper chamber.

15. The plug according to claim 1, wherein a ratio r of the extension of the guiding member in radial direction to the extension of the guiding member in axial direction is $5 \leq r \leq 25$.

16. A plug for releasably sealing a connection channel connecting an upper chamber comprising a first component with a lower chamber comprising a second component of a two-chamber container, the plug comprising a plug body insertable into the connection channel with a sealing force, a guiding member having a disk shape and configured for guiding the plug in an axial direction inside the connection channel, wherein the guiding member comprises a larger extension in radial direction than the plug body, is axially spaced with respect to the plug body by an unsealing distance, and has a discharge opening therethrough that is in communication with the unsealing distance, and a head part configured for pushing out a folded nozzle sealing the upper chamber, wherein the head part protrudes from the guiding member away from the plug body in the axial direction, has an outer diameter that is less than an outer diameter of the guiding member, and has a discharge channel therethrough that is in communication with the discharge opening of the guiding member, wherein the plug body and the head part are connected to the guiding member and the plug body, the guiding member, and the head part are one-piece made by injection molding.

17. The plug according to claim 16, further comprising:

at least one circumferential lamellae protruding in the radial direction from the plug body.

* * * * *